United States Patent [19]

Nakamura

[11] 4,330,878

[45] May 18, 1982

[54] SOUND PRODUCING DEVICE FOR WATCHES

[75] Inventor: Seiichi Nakamura, Tokorozawa, Japan

[73] Assignee: Citizen Watch Co., Ltd., Tokyo, Japan

[21] Appl. No.: 162,498

[22] Filed: Jun. 24, 1980

[30] Foreign Application Priority Data

Jun. 26, 1979 [JP] Japan ..... 54-80425

[51] Int. Cl.[3] ..... G04C 2/16

[52] U.S. Cl. ..... 368/250

[58] Field of Search ..... 368/72–74, 368/243–244, 250, 255, 88

[56] References Cited

U.S. PATENT DOCUMENTS 4,167,849 9/1979 Takahashi ..... 368/244

4,258,432 3/1981 Zafferri et al. ..... 368/250

*Primary Examiner*—Vit W. Miska

*Attorney, Agent, or Firm*—Birch, Stewart, Kolasch & Birch

[57] ABSTRACT

A sound producing device for watches comprising an electromagnetic exciting means having a coil and a permanent magnet, and first and second vibration plates disposed on opposite sides of the electromagnetic exciting means. The natural frequencies of both vibration plates are different from each other. The first vibration plate is vibrated by magnetic force and the vibration of the plate causes the resonant vibration of the second vibration plate.

5 Claims, 6 Drawing Figures

SOUND PRODUCING DEVICE FOR WATCHES

BACKGROUND OF THE INVENTION

The present invention provides a sound producing device for watches.

In recent years, it has been required that the sound producing device for the watch have a small size and make a complex tone or a simple melody. To this end, the sound producing device must be made to produce tones in the range of 1–1.5 octave having a central resonance frequency of 1–2 KHz. The desirable size of the sound device is less than 10 mm in diameter and less than 2.5 mm in thickness.

SUMMARY OF THE INVENTION

The object of the present invention is to provide a small electro-magnetic sound producing device which may be made in a considerable small size and have excellent frequency characteristics.

In accordance with the present invention, there is provided a sound producing device comprising an electromagnetic exciting means having a coil and a magnetic member, a first vibration plate provided adjacent one side of said electromagnetic exciting means, means provided on said first vibration plate for generating the vibration of the first vibration plate, a second vibration plate provided adjacent the other side of said electromagnetic exciting means, and passage means provided within said electromagnetic exciting means for allowing the sound wave to generate the vibration of said second vibration plate.

Other objects and advantages of the present invention will be apparent from the following description with reference to the accompanying drawings.

DESCRIPTION OF THE PREFERRED EMBODIMENTS

Figure 1:
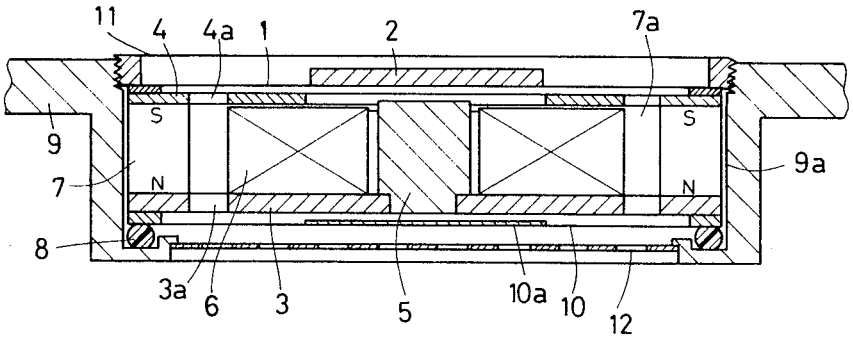
FIG. 1 is a sectional view of the sound producing device of the present invention.

Referring to FIG. 1, the sound producing device according to the first embodiment of the present invention comprises a first vibration plate 1 having a round plate 2 of magnetic material secured thereto at a central portion, a first side yoke 3 of magnetic material, and a second vibration thin plate 10. To the first side yoke 3, a central yoke 5 of magnetic material, an annular coil 6 and an annular permanent magnet 7 are secured in a suitable manner, for example with adhesives.

An annular second side yoke 4 of magnetic material is secured to the annular permanent magnet 7 adjacent the coil 6. Thus, there is provided a magnetic path connecting the central yoke 5, first side yoke 3, magnet 7, annular second side yoke 4 and round plate of magnetic material 2.

Between the coil 6 and the magnet 7, an annular gap 7*a* is provided. Further, the first and second yokes 3 and 4 are provided with a plurality of holes 3*a* and 4*a*. Thus, a sound wave passages are provided between the first and second vibration plates 1 and 10 by the holes 3*a* and 4*a*. In accordance with the present invention, natural frequencies of the first and second vibration plates 1, 10 are different from each other.

The sound producing device having an above described construction is engaged with a recess 9*a* provided in a watch case 9 through an O-ring 8 for the waterproof and secured thereto by a nut 11. Outside the sound device, a cover plate 12 having a plurality of sound holes is secured to the watch case 9. The second vibration plate 10 is made of suitable resilient material such as steel or thin plate plastic and acts also as a waterproof plate.

In operation, the first vibration plate 1 is vibrated by the magnetic force produced by pulses applied to the coil 6. The second vibration plate 10 is also vibrated by the sound wave travelling through holes 4*a* and 3*a* at a frequency different from the first vibration plate 10. Since natural frequencies of the first and second vibration plates are different from each other, frequency band of the device may be increased.

Figure 2:
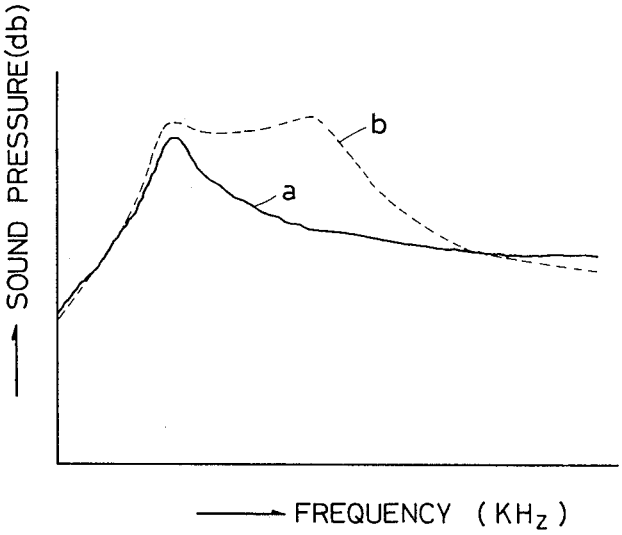
FIG. 2 is a graph showing a chracteristic of a sound device according to the present invention.

FIG. 2 is a graph showing frequency characteristics of sound producing devices. Curve "a" shows a frequency characteristic of a conventional device which comprises only one vibration plate of phosphor bronze. The curve "b" shows a frequency characteristic of a device of the present invention which comprises a first vibration plate of phosphor bronze and a second vibration plate of titanium. The curve "b" has two high level portions, so that the frequency characteristic is improved to increase the frequency band.

Figure 3:
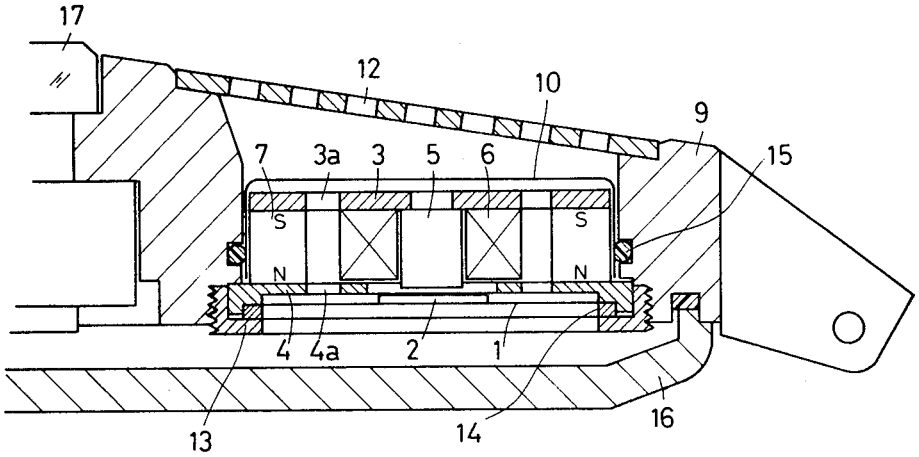
FIG. 3 is a sectional view of second embodiment of the present invention.

FIG. 3 shows the second embodiment of the present invention in which the same portion as the previous embodiment is designated by the same numeral as FIG. 1. The construction of this embodiment is similar to the first embodiment. The first vibration plate 1 and the second side yoke 4 are secured to the watch case 9 by a ring screw 13 through an annular spacer 14. The second vibration plate 10 has a cap shape and is pressed against a water-resisting O-ring 15. In the drawing, numeral 16 is a back and 17 is a glass. The cover plate 12 is provided on a front portion of the watch case 9.

In this embodiment, the second vibration plate 10 has a cap shape and secured to the watch case at the side upright portion. Accordingly, vibrating area of the vibration plate is greater than the first embodiment, so that the frequency characteristic may be improved.

Figure 4:
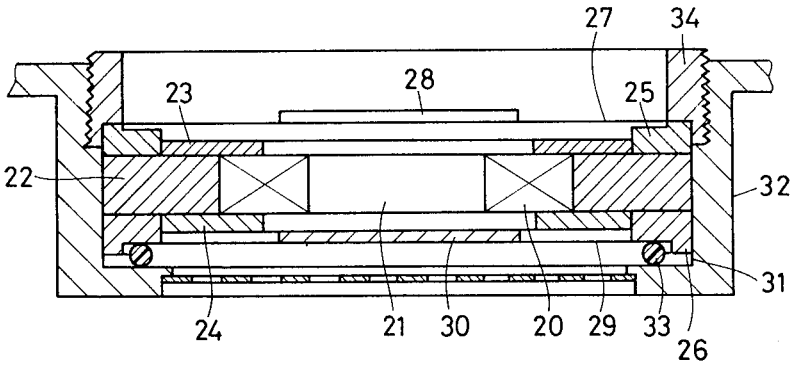
FIGS. 4 to 6 show other embodiments of the present invention, respectively.

Referring to FIG. 4, showing the third embodiment of the present invention, an electromagnetic exiting means of the sound producing device comprises a coil 20, a core 21 provided in the coil 20, and a plurality of sectional magnets 22 disposed around the coil 20. To the opposite sides of the magnets 22, a pair of supporting plates 23, 24 of magnetic material are secured with adhesives to integrate the coil 20 and magnets 22. Adjacent magnets 22 are disposed with a suitable space to provide a passage for sound wave. A plurality of holes (not shown) are provided in each of supporting plates 23, 24 to communicate with spaces between the magnets. A pair of annular frames 25, 26 are secured to opposite sides of the magnet 22. A first vibration plate 27 having a round attached weight 28 of magnetic material is secured to the frame 25 and a second vibration plate 29 having a round attached weight 30 of non-magnetic material is secured to the frame 26.

Thus, the above constructed sound producing device is engaged within a recess 31 of a watch case 32 through an O-ring 33 and secured thereto by a ring screw 34. By adjusting the weight of the auxiliary masses 28 and 30, it is possible to adjust the difference between the natural frequencies of the first and second vibration plates 27 and 29.

Operation of this device is similar to the previous embodiments. It will be seen that the core 5 in the previous embodiments and the core 21 of the third embodiment may be made of permanent magnet. Further, it is possible to forcibly vibrate both of the first and second vibration plates by attaching auxiliary masses 28 and 30 made of magnetic material.

Figure 5:
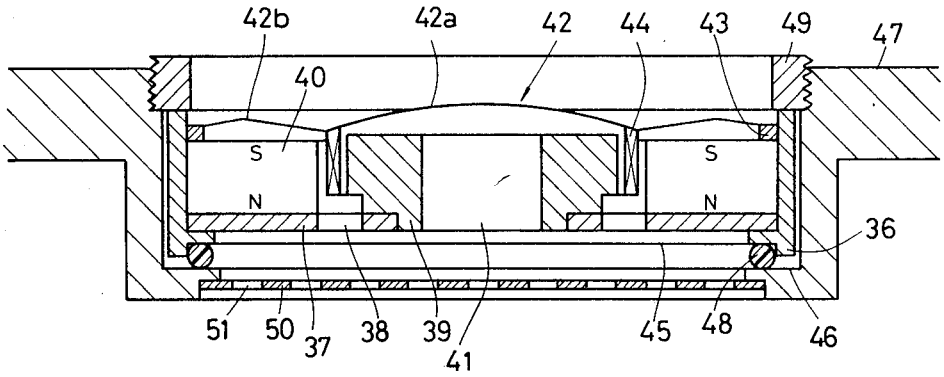

Referring to FIG. 5 showing a fourth embodiment, the device is a kind of the moving-coil speaker. The device comprises a cylindrical frame 36 made of non-magnetic material, an annular yoke 37 having a plurality of holes 38, a core 39 secured to the central portion of the yoke 37 and a plurality of sectorial permanent magnets 40 which are circumferentially arranged with a suitable space between adjacent magnets. The yoke 37 has also a plurality of holes (not shown) communicating with the space between the magnets and the core 39 has a central hole 41. Thus, spaces in opposite sides of the yoke and magnet assembly are communicated through a plurality of holes. A first vibration thin plate or sheet 42 is secured to the frame 36 at a position adjacent the permanent magnet 40 by a ring 43 with adhesives. The first vibration plate 42 made of paper or plastics having an excellent frequency characteristic and is formed into a shape having a central spherical portion 42*a* and a peripheral flexible portion 42*b*. A voice coil 44 is secured to the underside of the first vibration plate 42 so as to locate in the space between the permanent magnets 40 and the core 39. A second vibration plate 45 made of titanium or stainless steel plate is secured to the frame 36 adjacent the yoke 37. The second vibration plate 45 acts also as a water resisting means. The frame 36 is engaged with a recess 46 of a watch case 47 through an O-ring 48 and secured thereto by a ring screw 49. Outside the device, a cover 50 having a plurality of sound holes 51 is secured to the watch case 47.

Thus, a magnetic path connecting the permanent magnets 40, yoke 37 and core 39 is provided. By exciting the voice coil 44, the first vibration plate 42 is vibrated and the second vibration plate 45 is resonated by the sound wave from the first vibration plate 42 passing through communicating holes.

Figure 6:
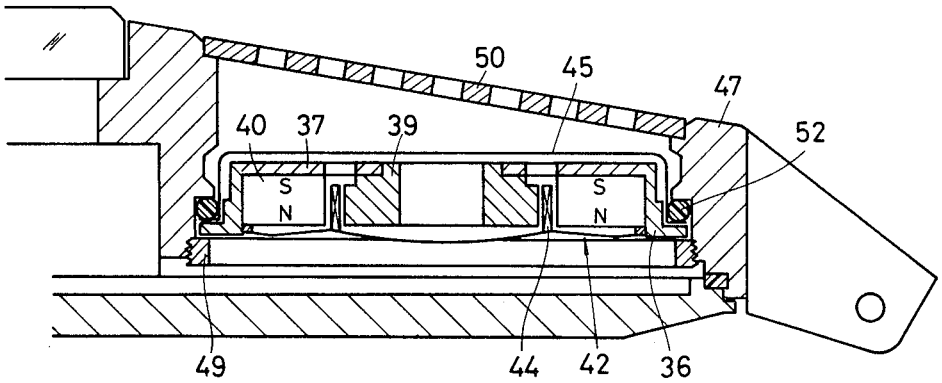

Referring to FIG. 6 showing the fifth embodiment, the device is similar to the fourth embodiment, in which the same part is identified by the same numeral as FIG. 5. In this device, the second vibration plate 45 is cap-shaped and engaged with the watch case 47 through an O-ring 52 at the upright portion. This construction is similar to FIG. 3. Thus, vibrating area of the second vibration plate 45 is increased, so that the frequency characteristic may be improved.

From the foregoing it will be understood that the present invention provides a sound producing device having an excellent frequency characteristic. Since, the first and second vibration plates are disposed adjacent opposite sides of the electromagnetic exciting device and one of the vibration plates is used also as watertight means, a special watertight means and a case for the sound producing device are not provided. Thus, the sound producing divice may be made into a small size. Further, the sound producing device of the present invention has a wide frequency band. Accordingly, it is possible to make a melody with the device.

What is claimed is:

1. A sound producing device for a watch having a watch case, comprising: an electromagnetic exciting means including a coil and a magnetic member, a first vibration plate provided adjacent one side of said electromagnetic exciting means, said first vibration plate being adapted to be vibrated by the magnetic force generated by said electromagnetic exciting means; a second vibration plate provided adjacent the other side of said electromagnetic exciting means, said second vibration plate being different from said first vibration plate in natural frequency; passage means provided in said electromagnetic exciting means for communicating between spaces on opposite sides of said electromagnetic exciting means, and means for securing said electromagnetic exciting means to said watch case together with a watertight means.

2. A sound producing device according to claim 1 wherein one of said vibration plates located in an outer side of said watch case is adapted to serve as watertight means.

3. A sound producing device according to claim 1 wherein each of said vibration plates has weight attached thereto.

4. A sound producing device according to claim 1 wherein one of said vibration plates has weight attached thereto.

5. A sound producing device according to claim 1 wherein one of said vibration plates includes a voice coil operated by the magnetic force in the device.

* * * * *